United States Patent [19]

Tanaka

[11] Patent Number: 4,758,857

[45] Date of Patent: Jul. 19, 1988

[54] AUTOMATIC FILM DEVELOPING MACHINE

[75] Inventor: Hiroyuki Tanaka, Yokohama, Japan

[73] Assignee: NIX Company, Ltd., Tokyo, Japan

[21] Appl. No.: 11,340

[22] Filed: Feb. 5, 1987

[30] Foreign Application Priority Data

Apr. 3, 1986 [JP] Japan ..... 61-49033[U]
May 23, 1986 [JP] Japan ..... 61-77047[U]

[51] Int. Cl.[4] ..... G03D 3/02; G03D 3/08
[52] U.S. Cl. ..... 354/320; 354/324
[58] Field of Search ..... 354/319, 320, 321, 322, 354/324; 134/64 P, 122 P

[56] References Cited

U.S. PATENT DOCUMENTS 3,613,547 10/1971 Snarr ..... 354/324
3,983,934 10/1976 Lee ..... 354/324
4,023,190 5/1977 Fassler ..... 354/319
4,171,716 10/1979 Szabo et al. ..... 354/324
4,252,429 2/1981 Hope et al. ..... 354/322
4,429,982 2/1984 Martino et al. ..... 354/319

*Primary Examiner*—A. A. Mathews
*Attorney, Agent, or Firm*—Wegner & Bretschneider

[57] ABSTRACT

A space is formed in an automatic film developing machine by side walls, a bottom wall and two pairs of film feed rollers. One of the two pairs of film feed rollers is arranged between front end portions of the side walls and the other pair of the film feed rollers is disposed between rear end portions of the side walls. The machine is equipped with a means for feeding a film processing solution to the space. At least one discharge pipe is also provided to discharge the film processing solution from the space. The discharge pipe communicates the space to a point outside the space. The upper end of the discharge pipe is positioned at a desired height higher than the nips of the paired film feed rollers whereas the lower end of the discharge pipe is in communication with a reservoir for the film processing solution.

7 Claims, 4 Drawing Sheets

AUTOMATIC FILM DEVELOPING MACHINE

BACKGROUND OF THE INVENTION

1. Field of the Invention

This invention relates to an automatic film developing machine for developing an exposed photographic film.

2. Description of the Prior Art

Conventional automatic developing machines for photographic films have such a structure that a photographic film is caused to pass through a developer-containing tank so as to develop the photographic film. A number of rollers are arranged in pairs in the tank. These rollers are rotated so that a film to be developed is pinched between the roller in each pair and is hence conveyed through the tank. Its development has been completed when the film is fed out of the tank.

In such a conventional developing machine, the film is transported through the developer in the small tank. It is hence necessary to have the film pass through the tank while bending same. The conventional developing machines are therefore accompanied by drawbacks that many rollers are required and the overall size of the developing machine becomes large.

With a view toward improving the drawbacks of such conventional developing machines, a developing machine has been proposed as disclosed in Japanese Utility Model Publication No. 20115/1985. Some of its structural features will next be described with reference to FIG. 1.

FIG. 1 is a cross-sectional side view of the automatic film developing machine proposed in the above publication. Numerals 1,2 indicate film feed rollers provided in a pair and letter a indicates their nip. Numeral 3,4 indicate film feed rollers provided in a pair in opposition to the film feed rollers 1,2. The nip of the film feed rollers 3,4 is also designated by a. The line connecting both nips a,a (i.e., the line shown in phantom in FIG. 1) is substantially horizontal. There are also illustrated a catch pan 5 provided underneath the paired film feed rollers 1,2,3,4, a bottom wall 5*a* of the catch pan 5, and a raised central portion 5*a'* of the bottom wall 5*a* of the catch pan 5. Numeral 5*b* indicates both side walls of the catch pan 5. However, one of the side walls 5*b* is only shown in FIG. 1. A space 6 is formed by the film feed rollers 1,2,3,4, catch pan 5 and side walls 5*b*. Designated at numerals 7,8 are blades provided respectively in elastic contact with the rollers 2,4 in order to avoid fluid leakage from the space 6. Numeral 9 indicates an overflow outlet formed through the side wall 5*b*. Designated at numeral 10 is a return pipe for collecting the developer overflowed to the outside from the space 6 and then recycling same to an unillustrated reservoir.

When the developer is pumped up from the unillustrated reservoir and is then charged into the space 6, the level of the developer rises in the space 6 and eventually reaches the height of the overflow outlet 9. When the developer is fed further, the developer overflows through the overflow outlet 9 to the outside of the space 6. The thus-overflowed developer is then recycled to the unillustrated reservoir through a return pipe 10. As a result, the level of the developer is always maintained at the height of the overflow outlet 9. As shown in FIG. 1, the overflow outlet 9 is formed at a height higher than the line which connects the nips a,a to each other. When the film feed rollers 1,2,3,4 are rotated in a direction indicated by arrows and a film to be developed is fed between the film feed rollers 1,2 on the left-hand side as viewed in the drawing, the film passes from the film feed rollers 1,2 and then through the developer in the space, and is thereafter fed out of the space 6 while being pinched between the film feed rollers 3,4. As a result, the film can be developed surely without being bent. Moreover, the opposing two pairs of rollers are only required so that the developing machine can itself be constructed in a small size.

In the above-described automatic film developing machine, the overflow outlet 9 is formed through the side wall 5*b*. The extra portion of the developer is therefore discharged continuously onto the outer surface of the side wall 5*b*. The outer surface is hence blemished. Moreover, the catch for receiving the developer discharged onto the outer wall must extend out from the side wall 5*b*, leading to another problem that the overall structure becomes large.

SUMMARY OF THE INVENTION

An object of this invention is therefore to provide an automatic film developing machine which can solve the above-described conventional problems and can avoid the blemish of the outer surface of the side wall and can also reduce the size of the overall structure.

In one aspect of this invention, there is thus provided an automatic film developing machine equipped with a space defined by side walls, a bottom wall and two pairs of film feed rollers, one of said two pairs of film feed rollers being arranged between front end portions of the side walls and the other pair of said film feed rollers being disposed between rear end portions of the side walls, and a means for feeding a film processing solution to the space, which comprises at least one discharge pipe for discharging the film processing solution, said discharge pipe communicating the space to a point outside the space, and the upper end of said discharge pipe being positioned at a desired height higher than the nips of the paired film feed rollers whereas the lower end of said discharge pipe being in communication with a reservoir for the film processing solution.

When the film processing solution is supplied to the space and the level of the film processing solution exceeds upwardly the upper end of the discharge pipe for the film processing solution, the extra portion of the film processing solution is discharged through the discharge pipe to the reservoir. Accordingly, the level of the film processing solution in the space is maintained at the height of the upper end of the discharge pipe for the film processing solution.

Owing to the provision of the discharge pipe for the film processing solution, it is possible to avoid the blemish of the side wall, which occurred due to the discharge of the film processing solution through the side wall, and also to reduce the size of the overall structure.

BRIEF DESCRIPTION OF THE DRAWINGS

The above and other objects, features and advantages of the present invention will become apparent from the following description of the invention and the appended claims, taken in conjunction with the accompanying drawings, in which:

DETAILED DESCRIPTION OF THE INVENTION AND PREFERRED EMBODIMENTS

Figure 1:
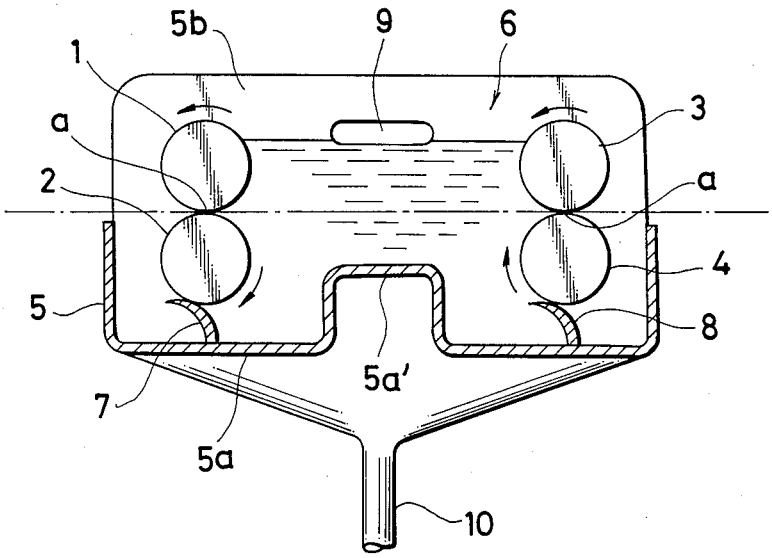
FIG. 1 PRIOR ART
FIG. 1 is a cross-sectional side view of a conventional automatic film developing machine.
Figure 2:
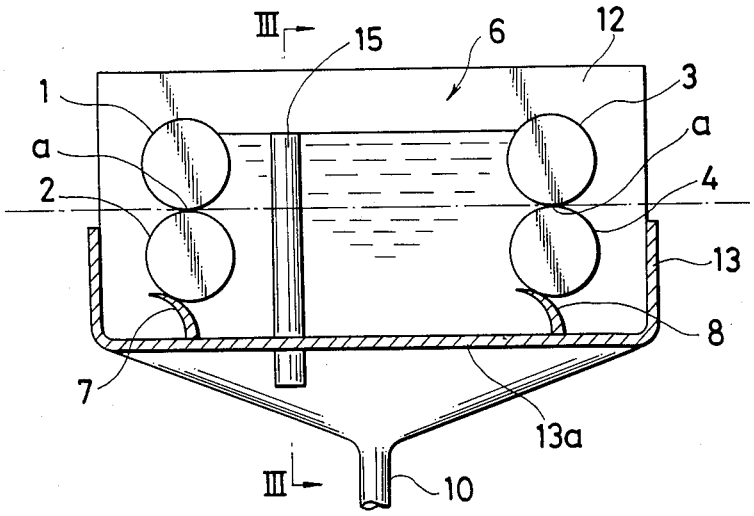
FIG. 2 is a cross-sectional side view of an automatic film developing machine according to the first embodiment of this invention.
Figure 3:
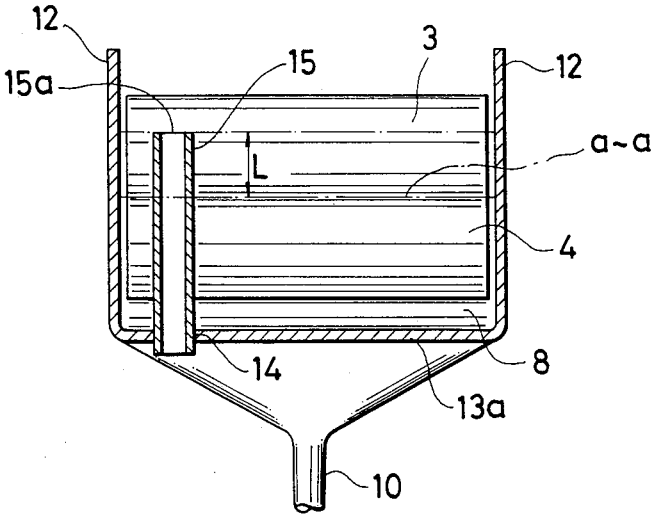
FIG. 3 is a cross-sectional view taken along line III—III of FIG. 2.

The first embodiment of this invention is now described with reference to FIGS. 2 and 3, in which the same elements of structure as those shown in FIG. 1 are indicated by the same reference numerals. Their description is therefore omitted here. Designated at numerals 12 and 13 are side walls and a catch pan respectively. The first embodiment is identical to the conventional automatic film developing machine depicted in FIG. 1 in that these side walls 12 and catch pan 13 form the space 6 together with the film feed rollers 1,2,3,4. Different from the side wall 5*b* shown in FIG. 1, no overflow outlet is however formed through the side wall 12. Unlike the catch pan 5 illustrated in FIG. 1, the catch pan 13 defines an opening 14 through a bottom wall 13*a* thereof. Designated at numeral 15 is a discharge pipe inserted in the opening 14. Owing to the insertion in the opening 14, the discharge pipe 15 is secured on the bottom wall 13*a* and extends into the space 6. The position of the discharge pipe 15 is close to the side wall 12 as shown in FIG. 3 so that each film is allowed to move freely through the space 6. Numeral 15*a* indicates the upper end of the discharge pipe 15. The height of the upper end 15*a* is determined in such a way that the upper end 15*a* is located at a position higher than the level connecting both nips a,a of the paired rollers 1–4 in the first embodiment, the upper end 15*a* is at a distance L above the level connecting both nips a,a.

When the developer is charged into the space 6 from the reservoir by means of an unillustrated pump, the level of the developer rises in the space 6 and eventually reaches the upper end 15*a* of the discharge pipe 15. Any developer higher than the height of the upper end 15*a* is then allowed to flow into the discharge pipe 15 and is discharged from the lower end of the discharge pipe 15 to the return pipe 10. If the diameter of the discharge pipe 15 is suitably chosen in view of the area of the space 6, the charge rate of the developer to the space 6 per unit time, etc., the level of the developer in the space 6 can be always maintained at the same level as the upper end 15*a* of the discharge pipe 15. When a film to be developed is conveyed by the paired rollers 1–4 in the above state, the film which passes along the level connecting the nips a,a is always caused to move through the developer so as to ensure its development.

In the above-described first embodiment of this invention, the discharge pipe is fixedly inserted in the opening formed through the bottom wall of the catch pan. The discharge pipe may however be fixed on the inner surface of the bottom wall of the catch pan and an opening may then be formed through the bottom wall of the catch pan at a location opposing the discharge pipe. The shape of the cross-section of the discharge pipe may be determined at will, for example, may be circular, rectangular, etc. The discharge pipe can be provided without obstructing the conveyance of a film even if the clearance between the side wall, which is located on the side of the discharge pipe, and the corresponding edge of the film, when a rectangular shape is chosen in particular. A plurality of discharge pipes may also be provided instead of a single discharge pipe. The discharge pipe can be provided in contact with either one of the side plate.

Figure 4:
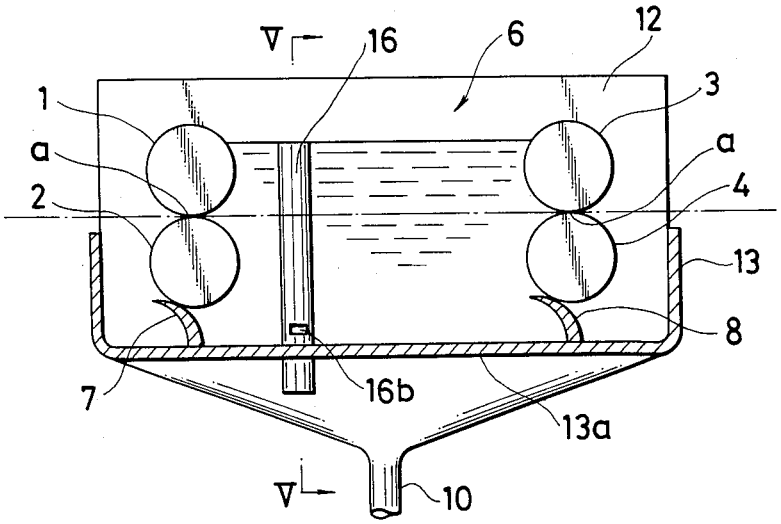
FIG. 4 is a cross-sectional side view of an automatic film developing machine according to the second embodiment of this invention.
Figure 5:
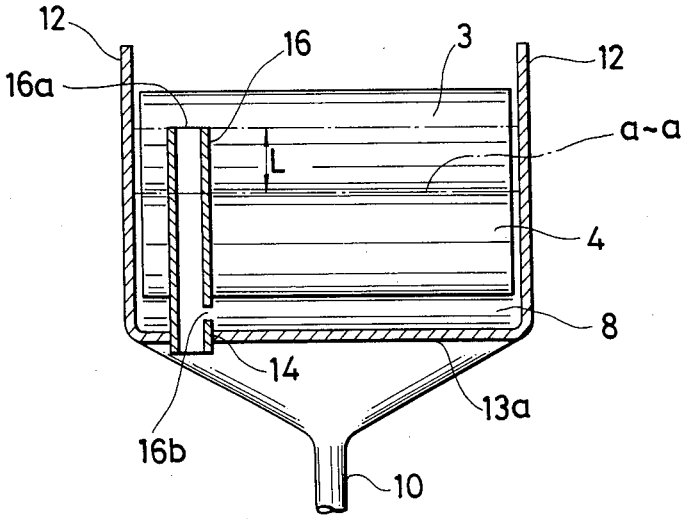
FIG. 5 is a cross-sectional view taken along line V—V of FIG. 4.

Referring next to FIGS. 4 and 5, the second embodiment of this invention will be described. In FIGS. 4 and 5, the same elements of structure as those shown in FIG. 1 are indicated by the same reference numerals. Their description is therefore omitted here. Designated at numerals 12 and 13 are side walls and a catch pan respectively. The second embodiment is identical to the conventional automatic film developing machine depicted in.FIG. 1 in that these side walls 12 and catch pan 13 form the space 6 together with the film feed rollers 1,2,3,4. Different from the side wall 5*b* shown in FIG. 1, no overflow outlet is however formed through the side wall 12. Unlike the catch pan 5 illustrated in FIG. 1, the catch pan 13 defines an opening 14 through a bottom wall 13*a* thereof. Designated at numeral 16 is a discharge pipe inserted in the opening 14. Owing to the insertion in the opening 14, the discharge pipe 16 is secured on the bottom wall 13*a* and extends into the space 6. The position of the discharge pipe 16 is close to the side wall 12 as shown in FIG. 5 so that each film is allowed to move freely through the space 6. Numeral 16*a* indicates the upper end of the discharge pipe 16. The height of the upper end 16*a* is determined in such a way that the upper end 16*a* is located at a position higher than the level connecting both nips a,a of the paired rollers 1–4. In the second embodiment, the upper end 16*a* is at a distance L above the level connecting both nips a,a. Numeral 16*b* indicates a bore formed through the wall of the discharge pipe 16 at a position close to the bottom wall 13*a*.

When the developer is charged into the space 6 from the reservoir by means of an unillustrated pump, the level of the developer rises in the space 6 since the developer is allowed to flow out through the bore 16*b* but the discharge rate of the developer is considerably lower than the charge rate of the developer. Therefore, the developer eventually reaches the upper end 16*a* of the discharge pipe 16. Any developer higher than the height of the upper end 16*a* is then allowed to flow into the discharge pipe 16 and is discharged from the lower end of the discharge pipe 16 to the return pipe 10 along with the developer discharged through the bore 16*b*. If the diameter of the discharge pipe 16 is suitably chosen in view of the area of the space 6, the charge rate of the developer to the space 6 per unit time, the size of the bore 16*b*, etc., the level of the developer in the space 6 can be always maintained at the same level as the upper end 16*a* of the discharge pipe 16. When a film to be developed is conveyed by the paired rollers 1–4 in the above state, the film which passes along the level connecting the nips a,a is always caused to move through the developer so as to ensure its development. Since the developer near the bottom wall 13*a* is always discharged through the bore 16*b* during each developing processing, dust which is floating in the developer is also discharged together with the developer. It is hence possible to maintain films and rollers from deposition of dust, thereby permitting good developing processing without any trouble. The thus-discharged dust is caught by a filter provided at the outlet of an unillustrated reservoir so that the dust does not flow back to the developer in the space 6.

In the above-described second embodiment of this invention, the discharge pipe is fixedly inserted in the opening formed through the bottom wall of the catch pan. The discharge pipe may however be fixed on the inner surface of the bottom wall of the catch pan and an opening may then be formed through the bottom wall of the catch pan at a location opposing the discharge pipe. The shape of the cross-section of the discharge pipe may be determined at will, for example, may be circular, rectangular, etc. The discharge pipe can be provided without obstructing the conveyance of a film even if the clearance between the side wall, which is located on the side of the discharge pipe, and the corresponding edge of the film, when a rectangular shape is chosen in particular. A plurality of discharge pipes may also be provided instead of a single discharge pipe. The discharge pipe can be provided in contact with either one of the side plate. Further, one or more bores may be formed through the wall of the discharge pipe. Where more than one bore is formed, they may be formed at different heights.

Figure 6:
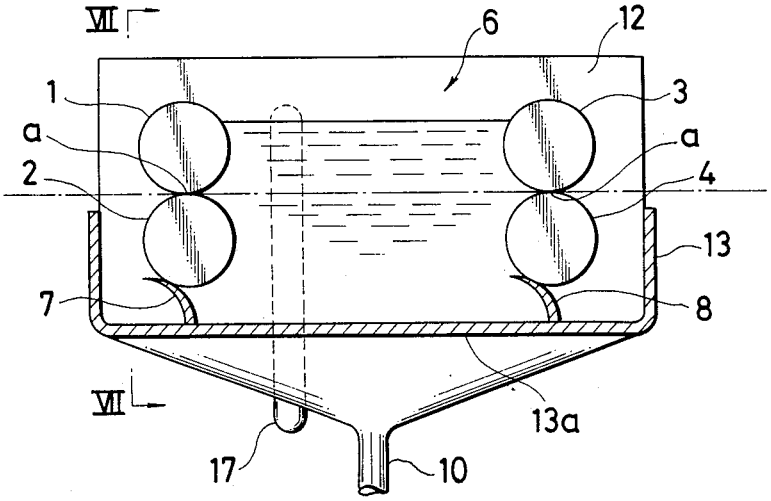
FIG. 6 is a cross-sectional side view of an automatic film developing machine according to the third embodiment of this invention.
Figure 7:
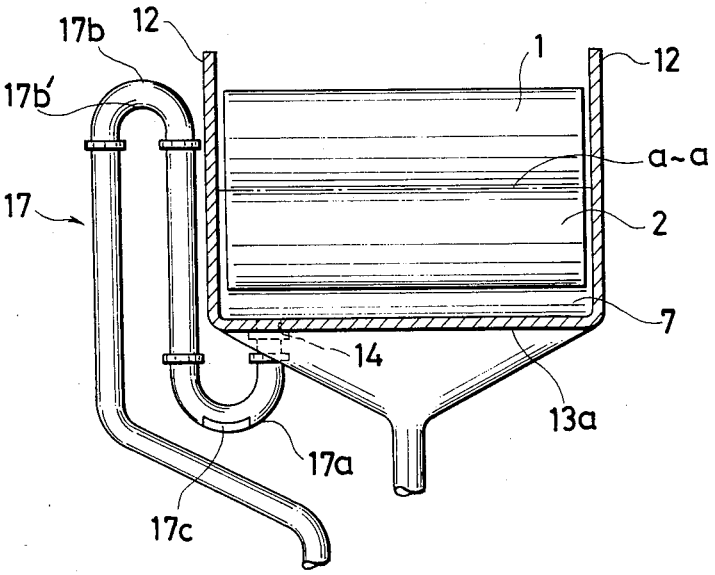
FIG. 7 is a cross-sectional view taken along line VII—VII of FIG. 6.

The third embodiment of this invention is now described with reference to FIGS. 6 and 7, in which the same elements of structure as those shown in FIG. 1 are indicated by the same reference numerals. Their description is therefore omitted here. Designated at numerals 12 and 13 are side walls and a catch pan respectively. The third embodiment is identical to the conventional automatic film developing machine depicted in FIG. 1 in that these side walls 12 and catch pan 13 form the space 6 together with the film feed rollers 1,2,3,4. Different from the side wall 5*b* shown in FIG. 1, no overflow outlet is however formed through the side wall 12. Unlike the catch pan 5 illustrated in FIG. 1, the catch pan 13 defines an opening 14 through a bottom wall 13*a* thereof. Designated at numeral 17 is a discharge pipe connected to the opening 14. The discharge pipe 17 has a lower U-pipe 17*a* and an upper U-pipe 17*b*. The U-pipes 17*a*,17*b* are detachable. Numeral 17*c* indicates a cover provided on the lower wall of a lower end portion of the lower U-pipe 17. The cover 17*c* is provided detachably on the lower U-pipe 17 by way of a suitable means. Although not seen in FIG. 7, there is a hole bored through the lower end portion of the lower U-pipe 17. The hole is normally closed by the cover 17*c*. The pipe 17 is provided in such a way that the inner bent portion 17*b*′ of the upper U-pipe 17*b* is sufficiently above the respective nips a,a of the film feed rollers 1,2,3,4 but is lower than the tops of the film feed rollers 1,3. The open end of the pipe 17 is positioned above an unillustrated reservoir.

When the developer is charged into the space 6 from the reservoir by means of an unillustrated pump, the developer flows first of all into the U-shape 17*a* through the opening 14. When the developer within the pipe 17 has reached the same level as the catch pan 13*a*, the developer begins to fill the space 6. Thereafter, the levels of the developer in the space 6 and the pipe 17 rise at the same rate. When the level of the developer in the space 6 upwardly exceeds first the line connecting the nips a,a of the film feed rollers 1,2,3,4 and then the height of the bent portion 17*b*′ of the U-pipe 17, the discharge of the developer from the space 6 to the reservoir begins through the opening of the bottom wall 13*a* of the catch pan 13 and the discharge pipe 17. Since the diameter of the discharge pipe 17 is chosen to have a diameter sufficient to allow the developer to flow out at the same rate as the charge rate of the developer from the reservoir to the space 6, the discharge rate of the developer through the pipe 17 is approximately equal to the charge rate of the developer from the reservoir. Accordingly, the level of the developer in the space 6 is always maintained at the same level as the bent portion 17*b*′. If the level of the bent portion 17*b*′ is set at an appropriate height between the tops of the film feed rollers 1,3 and the nips a,a of the paired film feed rollers 1,2,3,4, the level of the developer is always maintained at a suitable height above the film conveyance line which connects the nips a,a.

Moreover, the developer is discharged from the bottom of the space 6, through the opening 14 in the bottom wall 13*a* of the catch pan 13, and then via the pipe 17. Dust is not allowed to remain in the bottom of the space 6 but is discharged out of the space 6 together with the extra portion of the developer. As a consequence, no deleterious effects are given to films. A majority of the dust, which has been discharged from the space 6, is allowed to stay in the lower U-pipe 17*a* of the pipe 17, so that the thus-discharged dust is not recycled back to the space 6. Therefore, the lower U-pipe 17*a* has a function of dust removal. The dust, which has accumulated in the lower U-pipe 17*a*, can be discarded to the outside by either opening the cover 17*c* or removing the lower U-pipe 17*a* and cleaning same.

In the above-described third embodiment, the catch pan has the flat bottom wall as in the conventional automatic film developing machine shown in FIG. 1. If the entire bottom wall of the catch pan is formed in such a way that it slopes down toward the opening, the dust-discharging function increases apparently to a significant extent. As a further modification, the free end of the discharge pipe may be connected to the return pipe.

Having now fully described the invention, it will be apparent to one of ordinary skill in the art that many changes and modifications can be made thereto without departing from the spirit or scope of the invention as set forth herein.

I claim:

1. An automatic film developing machine comprising:

first and second side walls;

a bottom wall;

first and second pairs of film feed rollers, said side walls, bottom wall and feed rollers defining a space, and the first pair of film feed rollers being arranged between front end portions of the side walls, and the second pair of film feed rollers being disposed between rear end portions of the side walls;

means for feeding a film processing solution to the space; and at least one discharge pipe for discharging the film processing solution, the discharge pipe extending from the bottom wall into the space and communicating the space to a point outside the space, the lower end of said discharge pipe thereby communicating with a reservoir for the film processing solution, the upper end of the discharge pipe being positioned at a desired height higher than the nips of the paired film feed rollers so as to discharge the film processing solution, the level of which is higher than the desired height, through the bottom wall to a point outside the space and the discharge pipe including at least one bore formed at a predetermined position through the wall of the discharge pipe for discharging the film processing solution through the bore.

2. The automatic film developing machine as claimed in claim 1, wherein the discharge pipe is provided through an opening bored through the bottom wall.

3. The automatic film developing machine as claimed in claim 1, wherein the discharge pipe is provided in registration with an opening bored through the bottom wall and extends from the bottom wall into the space.

4. The automatic film developing machine as claimed in claim 1, wherein said at least one bore is provided in the vicinity of the bottom wall.

5. An automatic film developing machine comprising:

first and second side walls;

a bottom wall;

first and second pairs of film feed rollers, said side walls, bottom wall and feed rollers defining a space;

the first pair of film feed rollers being arranged between front end portions of the side walls;

the second pair of film feed rollers being disposed between rear end portions of the side walls;

means for feeding a film processing solution to the space; and at least one discharge pipe for discharging the film processing solution, wherein the discharge pipe has upper and lower bent portions and the lower bent portion extending from the bottom wall into the space and communicating the space to a point outside the space, the lower end of said discharge pipe thereby communicating with a reservoir for the film processing solution, and the upper bent portion is provided at a desired height higher than the nips of the paired film feed rollers.

6. The automatic film developing machine as claimed in claim 5, wherein the lower bent portion is detachable.

7. The automatic film developing machine as claimed in claim 5, wherein the lower bent portion defines a hole through a lower wall portion thereof and has a cover normally closing the hole.

* * * * *